US007556209B2

(12) United States Patent
Sears

(10) Patent No.: US 7,556,209 B2
(45) Date of Patent: Jul. 7, 2009

(54) RUBBER LAMINATE AND COMPOSITES INCLUDING THE LAMINATE

(76) Inventor: Ryan Michael Sears, 7792 Seabreeze Dr., Huntington Beach, CA (US) 92648

( * ) Notice: Subject to any disclaimer, the term of this patent is extended or adjusted under 35 U.S.C. 154(b) by 190 days.

(21) Appl. No.: 11/454,741

(22) Filed: Jun. 16, 2006

(65) Prior Publication Data

US 2007/0290061 A1 Dec. 20, 2007

(51) Int. Cl.
*E01B 9/38* (2006.01)

(52) U.S. Cl. ..... 238/264

(58) Field of Classification Search ..... 238/2, 238/6, 8, 264, 280, 283, 382
See application file for complete search history.

(56) References Cited

U.S. PATENT DOCUMENTS

| | | | | |
|---|---|---|---|---|
| 3,223,328 | A | 12/1965 | Moses et al. | |
| 3,295,760 | A | 1/1967 | Moses | |
| 3,565,336 | A | 2/1971 | Eisses | |
| 3,610,526 | A | 10/1971 | Burwell | |
| 3,662,951 | A | 5/1972 | Smith et al. | |
| 3,826,424 | A | 7/1974 | McClung et al. | |
| 3,904,112 | A | 9/1975 | Thim et al. | |
| 3,945,566 | A | 3/1976 | Bush | |
| 4,925,094 | A | 5/1990 | Buekett | |
| 5,110,046 | A | 5/1992 | Young | |
| 5,405,081 | A | 4/1995 | Bosshart | |
| 5,549,245 | A | 8/1996 | Kish | |
| 5,551,632 | A | 9/1996 | Kish et al. | |
| 5,551,633 | A | 9/1996 | Kish et al. | |
| 5,738,279 | A | 4/1998 | Ihle et al. | |
| 6,079,631 | A | 6/2000 | Ortwein et al. | |
| 6,296,195 | B1 | 10/2001 | Blank et al. | |
| 6,752,322 | B2 | 6/2004 | Ehrsam et al. | |
| 2004/0245353 | A1* | 12/2004 | Penny et al. | 238/264 |
| 2007/0034705 | A1* | 2/2007 | Gray | 238/8 |

FOREIGN PATENT DOCUMENTS

| | | |
|---|---|---|
| DE | 3834329 | 4/1989 |
| DE | 4000992 | 7/1991 |
| EP | 1 219 749 | 7/2002 |
| EP | 1 378 343 | 1/2004 |
| FR | 2 511 405 | 2/1983 |
| JP | 04-047001 | 2/1992 |
| JP | 09 272167 | 10/1997 |
| WO | WO 2004/033795 | 4/2004 |

* cited by examiner

*Primary Examiner*—S. Joseph Morano
*Assistant Examiner*—Robert J McCarry, Jr.
(74) *Attorney, Agent, or Firm*—Hudak, Shunk & Farine Co. LPA

(57) ABSTRACT

A rubber or elastomer laminate comprising a plurality of layers that can be vulcanized or crosslinked, wherein at least one of the layers includes a blowing agent. During vulcanization the layer containing the blowing agent expands to form a closed cell foam rubber layer. In a preferred embodiment, the closed cell foam rubber is interposed between two layers free or substantially free of a blowing agent. Composites, including the laminate, and preferably a metal article, most preferably a rail for use in an electric transit system, are formed by bonding the laminate to the metal article using a suitable bonding agent such as a rubber to metal adhesive. In a preferred embodiment, the unvulcanized laminate is applied or connected to the metal article prior to vulcanization. Rubber clad rail assemblies having a closed cell rubber foam layer and methods for preparing the same are disclosed.

29 Claims, 8 Drawing Sheets

RUBBER LAMINATE AND COMPOSITES INCLUDING THE LAMINATE

FIELD OF THE INVENTION

The present invention relates to a rubber or elastomer laminate comprising a plurality of layers that can be vulcanized or crosslinked, wherein at least one of the layers includes a blowing agent. During vulcanization, the layer containing the blowing agent expands to result in the cured laminate having at least one closed cell foam rubber layer. In a preferred embodiment, the closed cell foam rubber layer is interposed between two layers free or substantially free of a blowing agent, i.e. non-foamed rubber. Composites including the laminate and a substrate, wherein the substrate is preferably a metal article, most preferably a rail for use in an electric transit system, are formed by bonding the laminate to the metal article using a suitable bonding agent such as a rubber to metal adhesive. In a preferred embodiment, the unvulcanized laminate is applied or connected to the substrate such as the metal article prior to vulcanization. Rubber clad rail assemblies having a closed cell rubber foam layer and methods for preparing the same are disclosed.

BACKGROUND OF THE INVENTION

This invention relates to railway systems and more particularly relates to a novel and improved rail adaptable for use in electric transit systems of metropolitan areas.

It has been proposed in the past to utilize resilient pads beneath the lower flanges of railroad rails as well as railroad ties for cushioning the rails and insulating them electrically from the ties and from other underlying structures. In many cases, clamps are employed on opposite sides of the lower flange which are in turn anchored into the railroad ties or rail bed. Also, in some cases an adhesive is interposed between the pad and the rail.

Different considerations are involved in the construction and installation of rails for urban transit systems which are typically employed as a part of electrical transit systems and must be mounted in asphalt or concrete roadways. Instead of a gravel or dirt roadbed the rails are embedded in spaced parallel channels formed out of the existing roadway such that the top or head of the rail projects slightly above the upper end of the channel or roadway surface. In the past, rubber boots have been loosely disposed in surrounding relation to the bottom flange of the rail and typically held in place with the use of clamps extending along the entire length of the rail system. This approach has been unsatisfactory particularly from the standpoint of complete vibration and sound-proofing as well as providing the necessary resistance to corrosion resulting from stray electrical current. In stray current corrosion, an electrical current flowing in the environment adjacent to a structure causes one area on the structure to act as an anode and another area to act as a cathode. For example, in an electric railway, a pipeline or other structure may become a low resistance path for the current returning from the train to the power source. Whenever the pipeline is caused to be more positive by the stray current, corrosion occurs at a higher rate but can be avoided by proper insulation of the rail.

Over extended periods of time, rail systems of the type described have been wholly inadequate to achieve the necessary vibration and sound-proofing and to avoid corrosion from stray or leakage current of the types described.

SUMMARY OF THE INVENTION

A cured rubber or elastomer based laminate having a plurality of layers is disclosed, wherein one of the layers includes a closed cell rubber foam derived from a composition comprising rubber and a blowing agent. In a preferred embodiment, the layer comprising the blowing agent is bordered on each side by a rubber layer free of a blowing agent. Controlled expansion of the blowing agent containing layer is obtained during curing due to the arrangement of the layers.

Advantageously, the multiple layer laminate of the present invention provides high frequency vibration absorption and can provide low frequency vibration absorption when multiple layers of laminate are applied to each other to create extra thickness.

In one embodiment, the laminate of the present invention is applied to a metal or other substrate to form a composite. The laminate, as it is a dielectric material, i.e., non-conductive, can be used to provide insulating properties to all or a part of the substrate. Although the laminate can be cured prior to being bonded to the substrate, it is highly preferred that the unvulcanized laminate be applied or connected to the substrate prior to vulcanization. In this manner, the laminate is able to substantially conform to the dimensions of the substrate, which can have a complex shape, such as when the substrate is a rail.

The laminates of the present invention do not have to be cured in a mold to obtain a particular orientation. The laminates, after being applied to the substrate, can be directly placed in a curing vessel, such as an autoclave, wherein the laminate is subjected to a desired pressure and temperature to cure the same. The cured laminate conforms to the shape of the substrate it is applied to. Alternate cure systems can be utilized.

It is an object of the present invention to provide a construction comprising a cured laminate bonded to a rail to form a composite, wherein the composite is embedded or otherwise affixed in a rail bed, such as a ground surface or street.

It is therefore an object of the present invention to provide for a novel and improved insulated rail system and method of making same.

It is another object of the present invention to provide for a novel and improved rail system which is rugged, durable and comprised of a minimum number of parts.

It is a further object of the present invention to provide for a novel and improved insulated rail system which is vibration and sound-proof as well as capable of substantially eliminating any corrosion resulting from stray or leakage current and which enables greatly simplified installation over extended distances.

It is an additional object of the present invention to provide for a novel and improved method of manufacturing insulated rail in a minimum number of steps and which results in the formation of a rubber clad rail assembly.

A preferred form of the present invention resides in a transportation rail for extension along a rail bed, the rail having a bottom flange, top flange along which a train or other vehicle is advanced, and a vertical web portion interconnecting the bottom and top flanges and wherein the improvement comprises a rail cover composed of a resilient, dielectric vulcanizable material including a seat portion surrounding the bottom flange and upper side portions covering opposite sides of the web portion up to the top flange, and means for vulcanizing the cover to the seat portion and web portion of the rail. In another preferred form, a rigid skid plate surrounds the sides and underside of the bottom flange prior to placement in the guideway or channel formed in the roadway when used for electric trains and lateral extensions of the sides of the cover may cushion the rail against lateral thrusting or shifting.

A preferred method of manufacturing a rail section of the type described comprises the steps of positioning a sheet of a flexible dielectric material in surrounding relation to the base flange and opposite sides of the web portion along the substantial length of the rail section, and vulcanizing the sheet under heat and pressure to the rail section. If a skid plate is employed, the method further comprises the additional step of positioning the skid plate in surrounding relation to an underside and opposite sides of the bottom flange and vulcanizing the cover sheet and skid plate together with the rail. The cover sheet may be given additional thickness along opposite sides of the web portion, or separate strips of a flexible dielectric material maybe adhered to the sides of the cover sheet for additional cushioning and soundproofing.

Accordingly, one aspect of the present invention is a composite rail for trains or other vehicles, comprising a metal rail, and a laminate vulcanized to a portion of the metal rail utilizing a rubber-to-metal adhesive, wherein the laminate comprises two or more rubber-containing layers, wherein at least one layer (i) is a closed cell foam rubber layer, and wherein at least one layer (ii) of the laminate has less closed cell foam rubber than layer (i) or is free of closed cell foam rubber and is disposed on an outer surface of the laminate.

Another aspect of the present invention is a composite including a closed cell foam rubber layer, comprising a substrate having a dielectric laminate cured thereon, wherein the laminate includes a closed cell foam rubber layer interposed between a first rubber layer and a second rubber layer, said first and second rubber layers comprise less closed cell foam rubber than the closed cell foam rubber layer or free of closed cell foam rubber, said closed cell foam rubber layer derived from a composition including a blowing agent.

Still another aspect of the present invention is a method for preparing a composite rail, comprising the steps of applying an uncured laminate to a portion of a rail, and curing the laminate to form a composite rail, wherein the laminate comprises two or more layers, wherein a first rubber layer is a closed cell foam rubber layer derived from a rubber composition comprising a blowing agent, and wherein a second rubber layer of the laminate is disposed on an outer surface of the laminate, wherein the second rubber layer comprises less closed cell foam rubber than the first rubber layer or is free of closed cell foam rubber.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
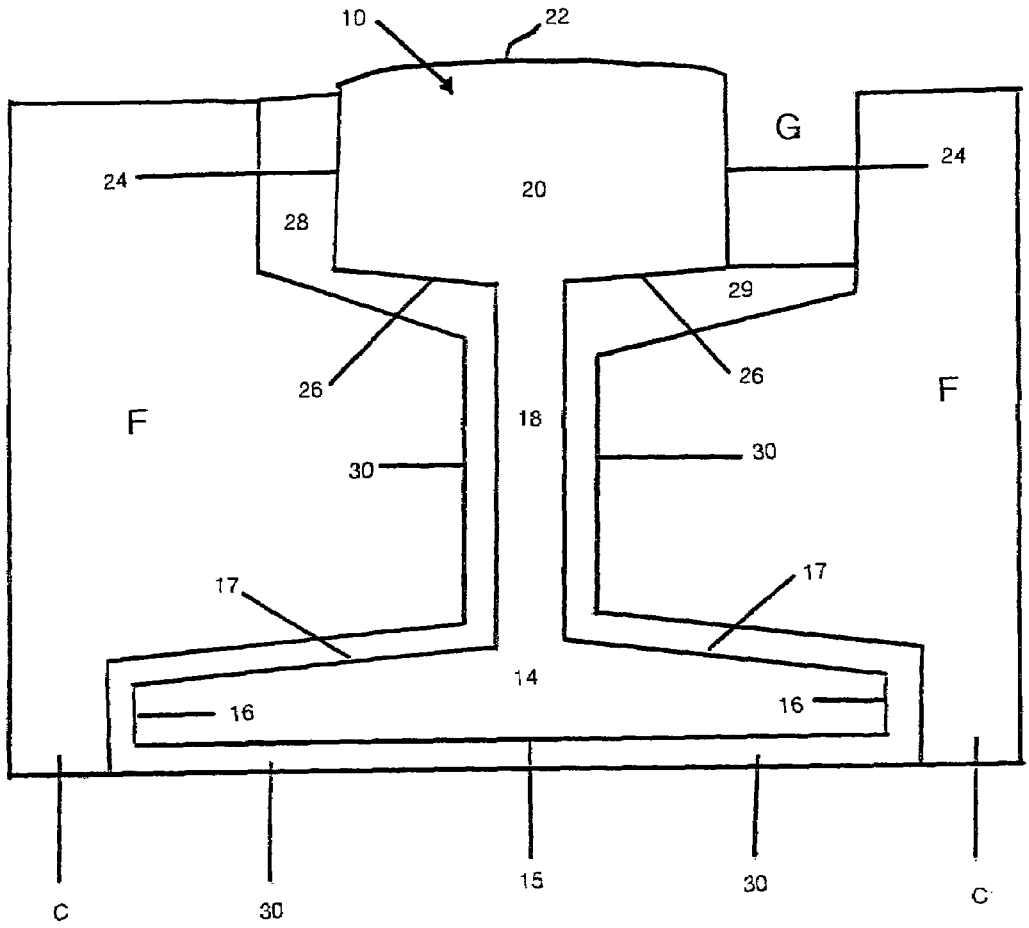
FIG. 1 is a cross-sectional view of one preferred form of rail in accordance with the present invention.

The present invention relates to a laminate comprising a plurality of vulcanizable rubber or elastomer layers, wherein at least one of the layers, after vulcanization, is a closed cell foam rubber layer. The closed cell foam rubber layer is derived from a composition comprising a rubber and a blowing agent. Composites including the laminate and a substrate, preferably a metal substrate, most preferably a rail for use in electric transit systems are disclosed.

The terms "rubber" and "elastomer" are used interchangeably throughout the specification to refer to compositions that can be or are vulcanized or cured and are thus thermoset in a particular orientation and having the properties of deformation and elastic recovery. Generally, any natural or synthetic rubber or elastomer can be utilized in each of the rubber layers of the laminate. Each rubber of a layer can be the same or different as another rubber of a different layer of the laminate. Preferably all rubbers of each layer of the laminate are the same, which generally enhances inter-ply adhesion.

Examples of rubbers suitable for use in the individual layers of the laminate include, but are not limited to, substantially conjugated diene rubbers which are generally defined as rubbers containing at least about 30 percent, at least about 50 or 60 percent, or at least about 70, 80 or 90 percent of repeat units therein derived from conjugated diene monomers. Substantially conjugated diene rubbers include nitrile rubber or various hydrocarbon rubbers, such as natural rubber, i.e., natural polyisoprene, as well as rubbers derived from one or more conjugated dienes having from 4 to about 12 carbon atoms with specific examples including butadiene, isoprene, pentadiene, hexadiene, 2,3-dimethyl-1,3-butadiene, octadiene, and the like. The rubbers of the present invention also include copolymers of the above-noted conjugated diene monomers with one or more vinyl substituted aromatic monomers containing from 8 to about 12 carbon atoms such as styrene, alpha-methyl styrene, t-butyl styrene, and the like. Examples of suitable hydrocarbon rubbers include, but are not limited to, polybutadiene, butyl rubber, polyisoprene, natural rubber, styrene-butadiene rubber, styrene isoprene rubber and the like.

Generally, any type of nitrile rubber can be utilized such as those made from monomers of acrylonitrile and a conjugated diene containing from 4 to about 10 carbon atoms such as butadiene, isoprene, pentadiene, hexadiene, etc., with butadiene being preferred. The amount by weight of repeat groups derived from acrylonitrile generally is from about 20 to about 45 parts by weight, desirably from about 25 to about 40 parts by weight, and preferably from about 30 to about 35 parts by weight per 100 parts by weight of the nitrile rubber.

The EPDM or EPM rubbers can also be utilized in the present invention and include ethylene-alpha-olefin-diene rubbers in the form of terpolymers, tetrapolymers, pentapolymers, and the like. The EPDM rubber comprises ethylene, one or more alpha-olefins other than ethylene with propylene being preferred, and one or more diene monomers which desirably are non-conjugated. The EPDM generally has a random arrangement of at least ethylene and alpha-olefin units in the polymer. Suitable alpha-olefin units, other than ethylene, are derived from monomers of propylene, 1-butene, 1-pentene, 1-hexene, 2-methylene-1-propene, 3-methylene-1-pentene, and the like. Examples of non-conjugated dienes include straight chain or cyclic hydrocarbon diolefins having a total of from about 6 to about 15 carbon atoms such as dicyclopentadiene, tetrahydroindene, alkyl-substituted tetrahydroindenes, 5-methylene-2-norbornene, 5-vinyl-2-norbornene, 2-methyl-norbornadiene, 2,4-dimethyl-2,7-octadiene, 1,4-hexadiene, 5-ethylidene-2-norbornene, and 3-methyl cyclopentene.

The EPDM of the present invention typically contains generally from about 40 to about 75 percent, desirably of from about 45 to about 70 percent, and preferably of from about 50 to about 65 percent by weight of ethylene repeating units. The amount of alpha-olefin repeat units other than ethylene is generally from about 15 to about 60 percent, desirably of from about 30 to about 55 percent, and preferably of from about 35 to about 50 percent by weight of alpha olefin repeating units. The amount of non-conjugated diene repeat units in the EPDM is generally from about 1 to about 15 percent, desirably from about 2 to about 10 percent, and preferably from about 3 to about 8 percent by weight. Suitable EPDM's for the present invention include those available from Bayer of Germany.

Rubbers suitable for use in the present invention further include halogenated rubbers derived from one or more halogen containing monomers, for example, polychloroprene, i.e. neoprene, bromobutyl rubber, chlorobutyl rubber and chlorosulfonated polyethylene rubber.

In a preferred embodiment of the present invention, the rubber utilized in the laminate includes natural rubber, neoprene, or EPDM and combinations thereof. Examples of rubber combinations include, for example, a blend of neoprene and natural rubber neoprene and a conjugated diene such as butadiene, and a blend of neoprene and EPDM. In one embodiment, the rubber blend of the present invention for use in a layer of the laminate which includes neoprene or another rubber in an amount greater than or equal to 50 parts, desirably 70 parts or more, and preferably 90 parts or more per 100 total parts by weight of rubber. Examples of suitable commercially available rubber include Neoprene W and Neoprene GRT from Dupont Performance Elastomers of Wilmington, Del., and SMR5 natural rubber polymer imported by RCMA Americas of Norfolk, Va.

In addition to the above-identified rubber components, the laminate layers of the present invention optionally include various additives, fillers, lubricants, stabilizers, accelerators, antioxidants, processing aids, tackifiers, compatibilizers, flame retardants, dispersing aids, colorants, and the like, which are utilized in conventional amounts. Non-limiting examples of fillers or reinforcing agents include both organic and inorganic fillers such as silica, organically modified silica, talc, clay, carbon black, and fibers such as wood fibers or glass fibers. Non-limiting examples of pigments or colorants include carbon black and titanium dioxide.

In an important aspect of the present invention, at least one rubber layer of the laminate comprises a blowing or foaming agent. During vulcanization, the particular blowing agent utilized decomposes and releases a gas, such as, but not limited to, nitrogen, carbon dioxide, carbon monoxide, ammonia, water vapor, or combinations thereof that provides the rubber layer with a cellular, preferably closed cellular, structure. The blowing agent is chosen to evolve gas at an appropriate temperature, such as a curing temperature, optionally in the presence of an activator such as triethanolamine, peroxides, treated urea, stearate such as barium stearate, lead stearate, calcium stearate, and zinc stearate, zinc oxide, adipic acid, benzoic acid, salicylic acid, or citric acid or combinations thereof. The curing process produces a cured rubber layer comprising cells with voids of a desired size derived from the decomposition of the blowing agent.

Examples of blowing agents suitable for use in the present invention include, but are not limited to, sodium bicarbonate, p-toluene sulfonyl semicarbazide, p-p'-oxbis (benzenesulfonyl hydrazide) and azodicarbonamide. Gas generation and the number and sizes of the closed cells produced depends on a number of factors including, but not limited to, amount and/or type of blowing agent, particular size of the blowing agent, exposure time, curing temperature, and activators utilized. In one embodiment, gas generation from blowing agent decomposition ranges from about a few cubic centimeters, i.e. about 1, 10, 20, to hundreds of, i.e. about 300, 500, 800 cubic centimeters per gram of blowing agent. For example, CELOGEN® 754A reportedly yields about 200 cc/gram on decomposition. The amount of blowing agent utilized in a blowing agent containing rubber layers of the present invention ranges generally from about 1 to about 20 parts per 100 total parts by weight of rubber, desirably from about 3 to about 10 parts per 100 total parts by weight of rubber, and preferably from about 4 to about 7 parts per 100 total parts by weight of rubber. Suitable blowing agents are available from Chemtura Corporation of Middlebury, Conn. as CELOGEN® under various designations as well as blowing agents pre-dispersed in a paste such as a naphthenic binder, available from Rhein Chemie of Mannheim, Germany, under the designations EC(AZ-130)-72, EC(5100)-72 and EC(754A)-68.

An important aspect of the present invention is to utilize at least one vulcanizing agent or crosslink to crosslink the rubber as known to one of ordinary skill. The choice of a crosslinking agent depends upon the rubber utilized. If the rubber component has no unsaturation or other functional group, then suitable crosslinking agents are peroxides. Specific examples of peroxide crosslinking agents include, but are not limited to, dibenzoyl peroxide, dicumyl peroxide, 1,3-bis(t-butyl-peroxyisopropyl)benzene, di-t-butyl peroxide, dilauroyl peroxide, 2,5-dimethyl-2,5-bis(t-butylperoxy) hexane, 2,5-dimethyl-2,5-bis(t-butylperoxy)hexene-3 and di(t-butylperoxy)-perbenzoate, or a combination thereof. Peroxides may be used with crosslinker coagents to improve the crosslinking efficiency. The common coagents used with peroxides have two or more unsaturated groups, or labile hydrogen groups. Examples are triallyl cyanuarate; triallyl isocyanuarate; di, tri and tetra methyacrylates and acrylates such as those available from ATOChem under the trade name SARTOMER®; liquid butadiene; and the like. Siloxane is an example of the latter type coagent.

For elastomers with unsaturation, the peroxides described above are utilized in one embodiment. In addition to the peroxides, alternative curatives include sulfur based curatives, dimethylol phenol (which is halogenated or non-halogenated) with Lewis acids, or silicone prepolymers with two or more SiH groups. The latter uses small amount of platinum or other metal complexes as a catalyst.

If the elastomer has a functional group, such as an acid, amine, isocyanate, epoxy or the like, curatives include a bifunctional or polyfunctional compound, or a polymer that will react with that particular group as a curative. Non-limiting specific examples of such crosslinking agents include metal oxides such as magnesium oxide, isocyanate prepolymers such as MONDUR® available from Bayer of Baytown, Tex., and neopentyl (diallyl)oxytri(N-ethylenediamino)ethyl titanate. Thus, for an acid functional rubber or elastomer, curatives include a compound, a prepolymer, or polymer containing an epoxy, alcohol, isocyanate, amine and the like functionalities that will react with the acid group.

The amount of crosslinking agent in each layer will depend upon the functionality and molecular weight of the crosslinking agent and desired level of crosslinking. That said, the amount of crosslinking or vulcanizing agent is generally small and ranges from about 0.3 to about 10 parts by weight, desirably from about 0.5 to about 7 parts by weight, and preferably from about 1 to about 5 parts by weight, based on 100 parts by weight of the rubber in each layer.

The rubber of each layer of the laminate, independently, is crosslinked so that generally greater than about 60%, desirably greater than about 80%, and preferably greater than about 95% by weight is insoluble in an appropriate solvent in which the non-crosslinked rubber is soluble. Thus, a high crosslink density and a substantially full cure is preferred.

The laminate of the present invention is formed by combining, i.e., mixing, blending or the like, predetermined amounts of the rubber component, crosslinking agent, and any other desired components together for each layer of the laminate; processing each layer in a desired manner, such as at an elevated temperature to form a desired layer of a desired configuration, such as a sheet; positioning the individual layers of the laminate together in a desired arrangement; and then vulcanizing the laminate. As described hereinabove, at least one of the layers includes a blowing agent which results in at least one of the layers having a closed cell foam configuration after vulcanization is performed. In one preferred embodiment, each layer of the laminate after mixing, blending or the like, is calendered or extruded to form individual sheets, pieces, or the like, which are then calendered together in a particular order as desired, prior to vulcanizing and thus forming an uncured laminate. When an extruder is utilized, extrusion generally occurs around 93° C. (200° F.), which is below the activation temperature of a blowing agent. Likewise, calendering occurs in a temperature range between about 54° C. (130° F.) to about 77° C. (170° F.), also below the activation temperature of a blowing agent.

Figure 6:
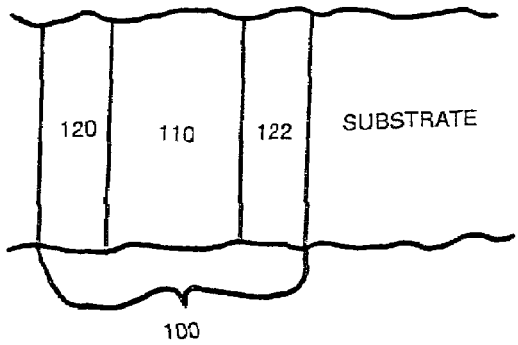
FIG. 6 is a cross-sectional view of one embodiment of a rubber laminate of the present invention including a closed cell foam rubber layer interposed between two rubber layers free of any closed cell foam.

As indicated hereinabove, laminates of the present invention are formed of two or more layers and preferably three or more layers with at least one layer including a blowing agent that produces a cured laminate layer having a closed cell foam configuration. In a preferred embodiment, a three layer laminate is produced such as shown in FIG. 6, wherein outer layer 120 and inner layer 122 are preferably free of a blowing agent and the center or interior layer 110 includes the blowing agent prior to curing. Inner layer 122 is shown bonded and vulcanized to a substrate, preferably utilizing a rubber-to-metal adhesive. Controlled expansion of the interior layer is obtained by interposing the same between two layers free of a blowing agent. As obvious from the above description, laminates of more layers, such as including two or more layers including a blowing agent, can be formed such as in a sandwich-like form or alternating of foamed and non-foamed layers in order to produce the desired effect. Likewise, it is to be understood that two or more blowing agent containing layers or non-blowing agent containing layers can be disposed adjacent one another. Moreover, two or more laminates can be disposed adjacent one another prior to or after curing to form a multi-laminate composite, wherein at least one layer of the total two or more laminates comprises a blowing agent. Therefore, one of the laminates can actually be of only solid rubber layers, or simply be one solid sheet of extruded rubber, for example.

In a preferred embodiment of a method used for forming a laminate of the present invention, three laminate layers are extruded or calendered and combined utilizing a three roll calender, wherein the interior layer of the laminate includes a blowing agent and produces a closed cell foam rubber layer upon vulcanization. Alternatively, a roller-die extruder with a calender that the extruder mouth feeds into can be utilized.

The thickness of each layer of the laminate and thus the total thickness of the laminate varies, depends on the application for which the laminate is intended. In one embodiment, the rubber layer free of a blowing agent has a maximum thickness that ranges from about 1 mm (0.039 inch) to about 20 mm (0.79 inch), desirably from about 2 mm (0.079 inch) to about 4 mm (0.157 inch), and preferably from about 2 mm (0.079 inch) to about 3 mm (0.118 inch) after curing. Maximum thickness of each closed cell foam layer after curing in one embodiment ranges generally from about 1 mm (0.040 inch) to about 30 mm (1.81 inch), desirably from about 3 mm (0.118 inches) to about 10 mm (0.394 inch), and preferably from about 4 mm (0.157 inch) to about 8 mm (0.315 inch). The thickness of each layer of laminate can vary, independently, along a length and/or width thereof as desired. The thickness of the closed cell foam layer can be adjusted to allow proper and/or desired deflection when under a load such as a train.

The laminates of the present invention are cured to vulcanize the rubber and produce at least one of the layers of the laminate having a closed cell foam configuration. In an important aspect of the present invention, the laminates need not be cured utilizing a mold. In a preferred embodiment, an autoclave, utilizing either a dry atmosphere or steam, and a desired pressure is utilized to vulcanize the laminate. Suitable curing temperatures for the laminate of the present invention range generally from about 121.11° C. (250° F.) to about 176.67° C. (350° F.), desirably from about 132.22° C. (270° F.) to about 165.56° C. (330° F.), and preferably from about 137.78° C. (280° F.) to about 160° C. (320° F.). Curing times generally are sufficient to produce the desired crosslinked density in each of the rubber layers with curing times generally ranging from about 1 to about 4 hours, and preferably about 2 hours. Autoclave pressure ranges generally from about 775.7 mm Hg (15 psi) to about 6206 mm Hg (120 psi), desirably from about 1396 mm Hg (27 psi) to about 4654 mm Hg (90 psi), and preferably is about 2069 mm Hg (40 psi). Alternatively, the laminate can be cured by utilizing a microwave cure system such as is available from Cober Electronics, Inc. of Norwalk, Conn.

In an alternative embodiment, a laminate of the present can be formed by extruding two or more layers of a laminate including at least one closed cell foam rubber containing layer into a desired configuration such as a sleeve having a desired outline, such as in the shape of a rail for example. The laminate sleeve or form is then bonded onto the substrate and cured prior or subsequent thereto. In one embodiment, an extruded laminate can be molded onto a substrate such as a rail.

In yet a further embodiment of the present invention, a composite is formed comprising a laminate of the present invention and a substrate. Examples of suitable substrates include, but are not limited to, materials including metal, ceramic, plastic, other rubbers or elastomers, cement, and concrete. Metal substrates are preferred with examples including steel, such as carbon steel and stainless steel being representative but non-limiting examples; copper; and aluminum. Substrates are not limited to any particular form and the laminate can be secured to all or only a portion thereof. Preferred substrates include a rail, a tank, mining chutes, media polisher barrels, door panels, etc.

The laminates of the present invention can be vulcanized prior to application to a substrate. However, in a preferred embodiment, it is desirable to attach an unvulcanized laminate to a desired substrate, optionally with a rubber-to-metal adhesive or bonding agent, and then vulcanize the laminate. Laminates of the present invention are applied to a substrate that is preferably clean and free of loose materials, such as rust or other oxides. Conventional techniques for cleaning substrates may be used. Examples of suitable rubber-to-metal adhesives or bonding agents that can be utilized together or individually include, but are not limited to, CHEMLOK® adhesives available from Lord Corporation of Cary, N.C. under the designations such as 205, 252X, 289, and 290. A bonding agent such as a polymer-based tack cement can be utilized to bond the laminate to the substrate, holding the laminate in place prior to and during vulcanization.

One embodiment of a laminate 100 of the present invention is illustrated in FIG. 6. Laminate 100 includes a closed cell foam interior layer 110 interposed between two layers 120, 122 of a formulation free of a blowing agent. As further described hereinbelow, one of the layers of the laminate, in this case layer 122, is utilized as a bonding layer that is applied to a portion of a substrate. Layer 120 is thereby the outer layer exposed to the ambient environment. In one embodiment, outer layer, can have an article or object bonded or in contact therewith. Layer 120 plays a critical role in the laminate of the present invention and during vulcanization does not allow the closed cell foam layer 110 to over expand. Layer 120 stretches sufficiently to maintain layer 110 in a controlled expansion and allows the air pockets resulting from decomposition of the blowing agent to be more tightly compacted and thereby improve the resilience and spring rate of the laminate.

Figure 7:
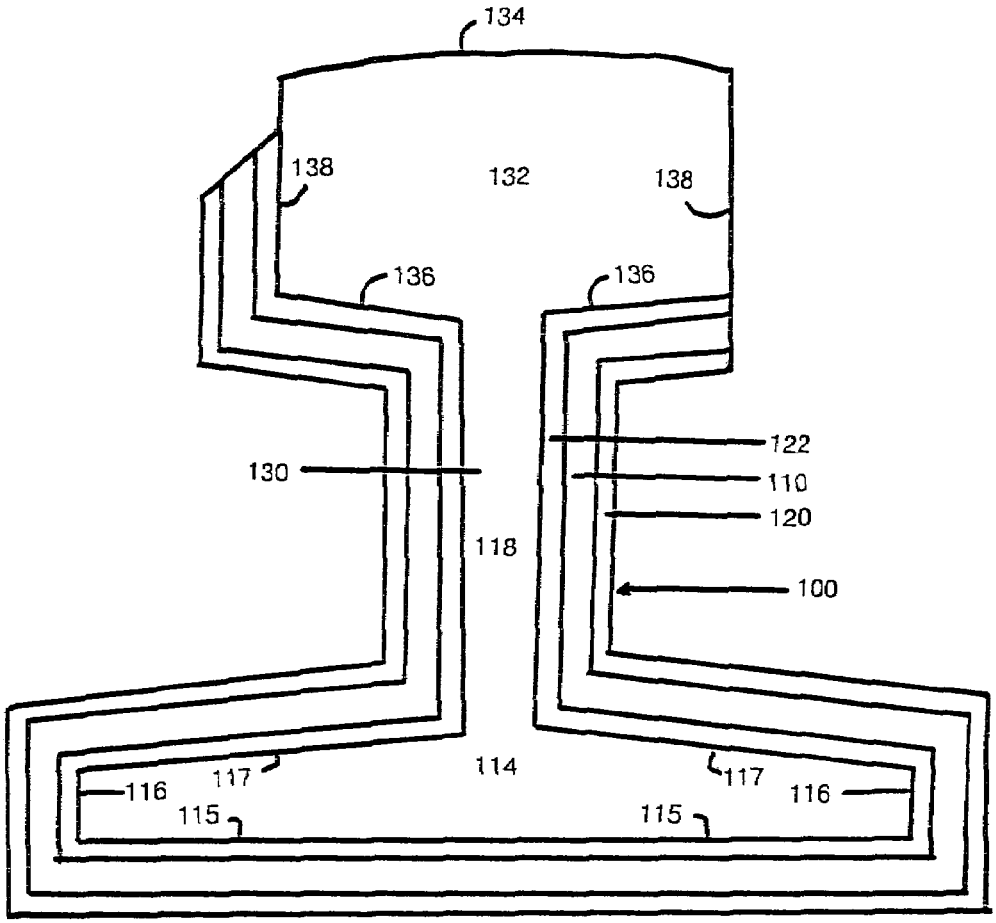
FIG. 7 is a cross-sectional view of one embodiment of a composite of the present invention, wherein the composite comprises a rail having a laminate of the present invention bonded thereto.

Referring now to FIG. 7, a preferred embodiment of the present invention is a composite form of rail including a rail 130 and a rail cover which is a laminate 100 of the present invention. Rail 130 has a generally I-shaped cross-sectional configuration and includes a bottom flange 114 with a lower surface 115, opposite sides 116, and sloped upper surfaces 117 which merge into a web portion 118. Rail 130 further includes a top or upper flange 132, preferably having a convex top surface 134 and a preferably sloped undersurface 136 that generally connects to the upper end of vertical web portion 118. In a preferred embodiment, the bottom flange 114 has a greater width than the top flange 132 in order to provide stability to the rail.

Rail 130 has bonded thereto laminate 100 preferably utilizing a bonding agent (not shown). More specifically, bonding layer 122 is situated adjacent to desired portions of rail 130. As illustrated, the laminate 100 covers the entire bottom flange 114, web portion 118 and a portion of upper flange 132. In a preferred embodiment, the laminate may terminate under upper flange 132 or on the sides 138 of the upper flange, most preferably no higher than flush with the top of the upper flange.

Figure 8A:
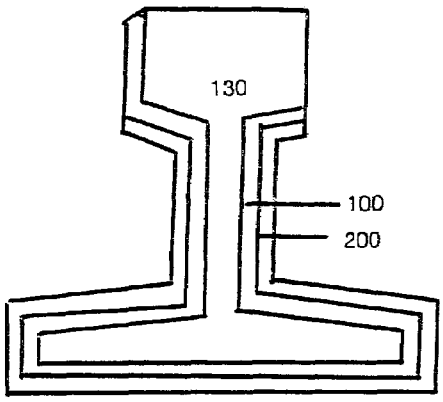
FIGS. 8A-8D relate to different embodiments of a composite of the present invention including one or more laminates bonded to a metal substrate, particularly a portion of a rail, wherein at least one layer of one of the laminates includes a closed cell foam rubber layer.
Figure 8B:
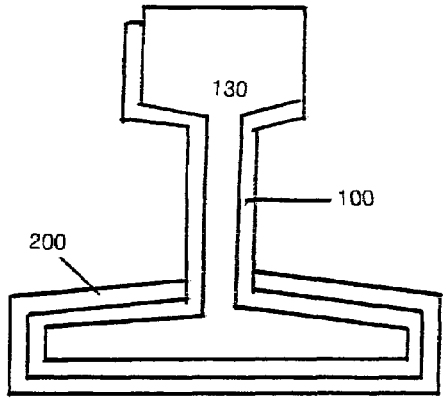
Figure 8C:
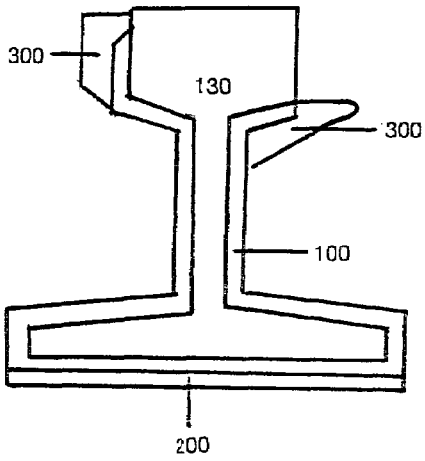
Figure 8D:
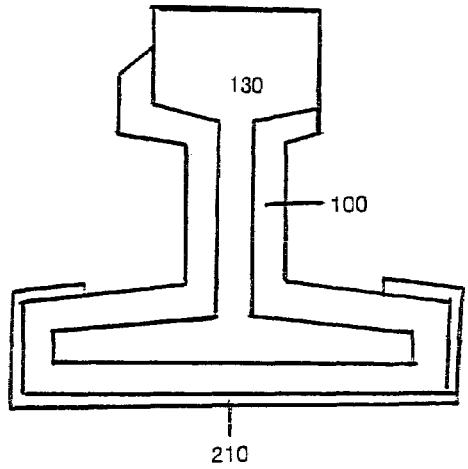

Further embodiments showing the laminate 100 of the present invention applied to a substrate, namely a rail 130 are illustrated in FIGS. 8A through 8D. FIG. 8A illustrates the laminate 100 bonded to rail 130 such that the bottom flange or foot of the rail are covered by the laminate with the ends of laminate ending along a portion of the web, below the top surface of the rail. A second laminate 200, which can be free of a closed cell form rubber layer, is bonded to a portion of laminate 100. FIG. 8B illustrates a laminate 100 bonded to rail 130, similar to FIG. 8A, wherein the coverage of second laminate 200 extends around the bottom flange and generally ends at the rail web. FIG. 8C further includes a second laminate 200 of the present invention, which can be the same or different as laminate 100 bonded to laminate 100, in this case along the lower edge thereof. As illustrated, one or more attachments 300, in this case two attachments are shown connected to the composite. In a preferred embodiment, the attachment is formed comprising rubber and can be an extruded attachment. Attachment 300 can either be co-cured with laminate 100 or can be cold bonded to laminate 100, or other portion of the composite after laminate 100 has been applied thereto. In one embodiment, attachment 300 can comprise a closed cell foam rubber. Attachment 300 can be formed in any shape as desired, and can be connected to any desired portion of laminate 100 or the composite. FIG. 8D illustrates laminate 100 further connected to an additional substrate 210, in this case, a metal channel which is utilized to prevent compression or distortion of the laminate and also protect the same.

Figure 9:
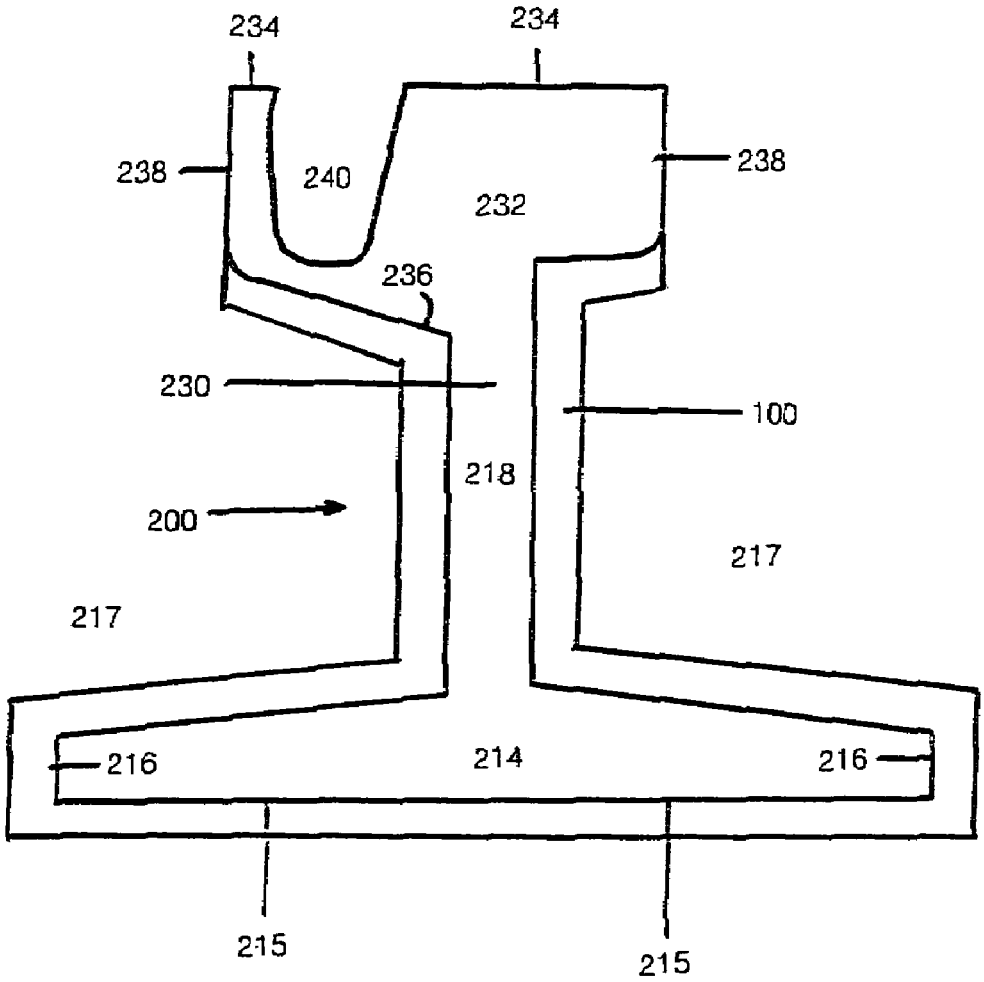
FIG. 9 is a perspective view of a further embodiment of the composite of the present invention, namely a laminate including a closed cell foam layer bonded to a rail having a groove on the upper flange thereof.

Yet a further embodiment of a composite of the present invention is illustrated in FIG. 9. Composite 200 comprises a laminate 100 including a closed cell foam rubber layer interposed between two rubber layers as described hereinabove that are free of a closed cell foam rubber. Laminate 100 is cured and has been bonded to substrate which is a rail 230 during vulcanization. Rail 230 includes a bottom flange 214 including a lower surface 215, preferably planar or substantially planar, opposite sides 216, and upper sloped surfaces 217 which connect to web 218. Rail 230 further includes a top flange 232 including a top surface 234 that includes a rail groove 240. Top flange 232 includes a sloped under surface 236 and sides 238 as illustrated.

One preferred embodiment for preparing a rail laminate composite is as follows. The rubber layers, including desired components, are individually mixed on a mill or Banbury mixer to disperse the components thereof. At least one of the layers (i) includes a blowing agent and at least one of the layers (ii) contains less blowing agent than layer (i) and is preferably substantially free or free of a blowing agent. The layers are individually calendered or extruded to desired thickness and then pressed together using a 2, 3, or 4 roll calender. The uncured laminate is calendered onto a backing sheet such as a polymer film and rolled up. The substrate, in this example a rail, is abrasive blasted or cleaned in another manner, one or more bonding agents are applied, and tack cement may be applied to rail/substrate and bonding side of laminate. The laminate is applied to rail/substrate by hand with rollers, or using automated roller system, carefully eliminating any trapped air between substrate and laminate. Multiple sheets of the laminate, i.e. two or more laminates, may be applied onto each other to increase cover thickness. The rail with laminate attached is placed in an autoclave or passed through microwave for vulcanization. Other rubber attachments (cured or uncured) to laminate and rail may be installed prior to or after vulcanization. Ends of the rail are preferably left exposed to allow for weld connection with another rail, and are to be covered in-situ after weld connection. The exposed weld connection may be covered with pre-cured rubber cover, or uncured rubber cover which is vulcanized in-situ using chemical curing agent and/or heat, or other type of sealant.

As described hereinabove, the laminates of the present invention including at least one layer that is a closed cell foam rubber layer, preferably interposed between two layers derived from a composition free of a blowing agent, and thus are not closed cell foam-containing rubber layers, exhibit desired properties after the laminate has been cured. In one embodiment, it is desired that a cured laminate of the present invention have a compression set as measured by ASTM D-395 (Method B) of less than or equal to 25% maximum loss. Preferred cured laminates have a desired deflection as measured by ASTM D-5592, two cycles per minute for 16 hrs. or to failure, have no failure. It is preferred that the cured laminate has an adhesion value to steel, as measured by ASTM D-429 (Method E) achieve at least 30 psi minimum, and preferably greater than 50 psi. Dielectric strength of a cured laminate of the present invention according to ASTM D-149 achieves a dielectric strength of at least 400 volts per mil. It is preferred that the laminate passes a Holiday Test, which involves passing an electric current over the entire exposed surface of the laminate and using a device to detect if the current reaches past the rubber to a conductive substrate, such as a steel rail, which would indicate a "holiday". It is preferred that the cured laminate has no holidays at or below 15,000 volts. The laminate of the present invention, including at least one closed cell foam rubber layer, preferably achieves a desired result according to an acoustic stiffness test which is defined as a ratio of dynamic stiffness to static stiffness. The static stiffness is measured by applying a vertical downward load through pneumatic springs from 0 to 50 kN in 2.5 kN increments measuring the resulting deflection and determining the resulting stiffness from the load vs. deflection curve. The static stiffness of the laminate is average secant stiffness over desired range, in one embodiment for example 17.5 kN to 37.5 kN. The dynamic stiffness of the laminate is a function of frequency under dead loads, a preload, on the order of 15 kN to 40 kN, depending on application, with superimposed oscillatory loads on the order of those generated by wheel/rail roughness. The peak dynamic deflection and load is then compared to the static deflections and loads to determine the dynamic to static stiffness ratio. It is desired that the dynamic to static stiffness ratio is 1.4:1 or less for laminates of the present invention including a closed cell foam rubber layer.

In one embodiment of the present invention, a composite, including a laminate, having a closed cell foam rubber layer, adhered to a portion of a rail is embedded in or otherwise connected to a street, rail bed, or the like. Rail is affixed to a rail bed, sleeper, or the like using a clip which is fastened to the top of the foot of the rail and fixed to the rail bed, sleeper, or the like. Similar rail clips are manufactured by Pandrol Rail Fastenings of Addlestone Surrey, UK or Voest Alpine Schienen of Leoben, Austria.

Figure 10:
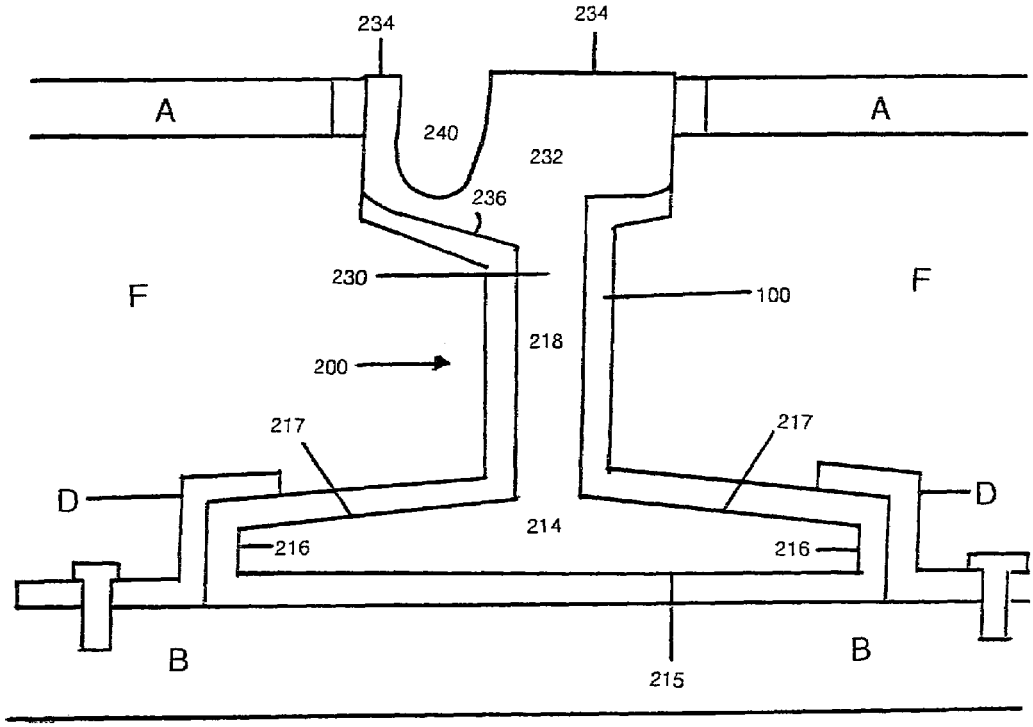
FIG. 10 is a vertical cross-sectional view of one embodiment of a composite laminate rail embedded in a street or rail bed.

For example, in one embodiment of the present invention as shown in FIG. 10, a composite 200 including a cured laminate 100, having a closed cell foam rubber layer is connected to rail 230. The base of composite 200 is situated upon a rail bed or sleeper B and connected thereto utilizing a rail fastener or clip D in one embodiment as illustrated. A suitable filler F is placed around the composite after the same has been laid and appropriately connected to an additional composite rail. The filler may be a concrete filler or generally any other filler employed in the art. Asphalt or other street surface A is placed on filler F as desired. A gap is generally left on either side of the top flange 232 of the rail in order not to interfere with a train wheel.

Accordingly, in one embodiment, the composite of the present invention comprises a rubber sleeve containing a closed cell foam layer that is permanently bonded to a rail for the purpose of vibration and noise absorption, stray current control and corrosion protection. The laminates of the present invention are preferably resistant to ozone, solvents such as hydrocarbons, salts or solutions utilized for deicing, or other typical road or rail encountered chemicals.

EXAMPLES

A three layer laminate of the present invention was prepared from the following compositions. The laminate included a bonding layer, an outer layer, and a closed cell foam containing rubber layer of the following components.

| Component | Bonding Layer (parts by wt.) | Outer Layer (parts by wt.) | Closed Cell Foam Layer (parts by wt.) |
|---|---|---|---|
| Neoprene W[1] | 75 | 75 | 75 |
| Neoprene GRT[1] | 20 | 20 | 20 |
| Takteen 220[2] (polybutadiene) | 5 | 5 | 5 |
| Stearic Acid[3] | 1 | 1 | 1 |
| Maglite D[4] (magnesium oxide) | 4 | 4 | 4 |
| Wingstay 100[5] (anti-ozonant) | 3 | 3 | 3 |
| Sunproof Jr.[5] (anti-ozonant) | 2 | 2 | 2 |
| AC Poly[6] (polyethylene wax (proc. aid)) | 3 | 3 | 3 |
| N762[7] (carbon black) | 65 | 65 | 65 |
| Translink 37[8] (Clay Filler) | 25 | 25 | 25 |
| Califlux LP[9] (plasticizer) | 20 | 20 | 20 |
| Wingstay 95[10] (tackifier) | 3 | 3 | 3 |
| Celogen 754A[11] (blowing agent) | 0 | 0 | 5 |
| Zinc Oxide[12] (vulcanizing agent) | 5 | 5 | 5 |
| PEC 2944[13] (vulcanizing agent) | 1 | 1 | 1 |
| TOTAL PARTS | 252 | 252 | 257 |

Manufacturers:
[1]Dupont Performance Elastomers of Wilmington, DE
[2]Lanxess Corp. of Ontario, Canada
[3]Musimmas of Indonesia
[4]Rohm and Haas of Philadelphia, PA
[5]Crystal PMC of Lansdale, PA
[6]Akrochem of Akron, OH (distributor)
[7]Nhumo of Mexico
[8]Engelhard Corp. Iseln, NJ
[9]Sunco of Philadelphia, PA
[10]RT Vanderbilt (distributor)
[11]Chemtura Corp. of Middlebury, CT
[12]US Zinc/HB Chemical of Cuyahoga Falls, OH
[13]Akrochem of Akron, OH (distributor)

Each of the indicated rubber layers were individually mixed on a mill to disperse the components within each layer. The layers were each calendered to a thickness between about 1/16" to 1/8" and then pressed together using a 3 roll calender, with the blowing agent containing layer being the center layer. The uncured laminate was applied to a cleaned rail utilizing Chemlok 205 and 252X as rubber-to-metal adhesive bonding agents and a neoprene based tack cement. The laminate was applied to the rail utilizing rollers, the rail with laminate was placed in an autoclave and cured at 143° C. (290° F.) temperature and 2223 mmHg (43 psi) pressure for 2.5 hours. The resulting composite was a rail having a laminate of the present invention bonded thereto.

Referring in more detail to the drawings, FIG. 1 illustrates one preferred form of a composite rail which is made up of a standard rail 10 and a rail cover 30. The rail 10 is of generally I-shaped cross sectional configuration having a bottom flange 14 provided with a flat undersurface 15 and opposite sides 16 together with sloped upper surfaces 17 which merge into a vertical web portion 18. A top flange 20 has a slightly convex top surface 22 and opposite sides 24 together with sloped undersurfaces 26 which merge into the upper end of the vertical web portion 18. In accordance with conventional practice, the rail maybe composed of various grades of steel or aluminum depending upon load requirements. As a setting for the present invention, the rail is composed of steel and is designed with a relatively broad base flange 14 in comparison to the width of the top flange 20.

In accordance with the present invention, the rail is adapted for use as a railroad track for the prevention of corrosion due to stray current leakage in electrified rail transit systems operating in metropolitan areas. To this end, the rail 10 is clad with a tough, durable elastomeric sheet or cover 30 which is vulcanized to the rail and specifically in such a way as to cover the entire base flange 14, opposite sides of the web portion 18 and undersides 26 of the top flange 20. One side 28 of the cover is of progressively increased thickness along the underside of the top flange and terminates in a lobe 28' along one side of the top flange; whereas, the opposite side 29 is of progressively increased thickness along the underside of the top flange and terminates in a tapered end 29' beneath the side of the top flange so as to leave clearance along that side for the wheel flange of each of the train wheels.

Figure 2:
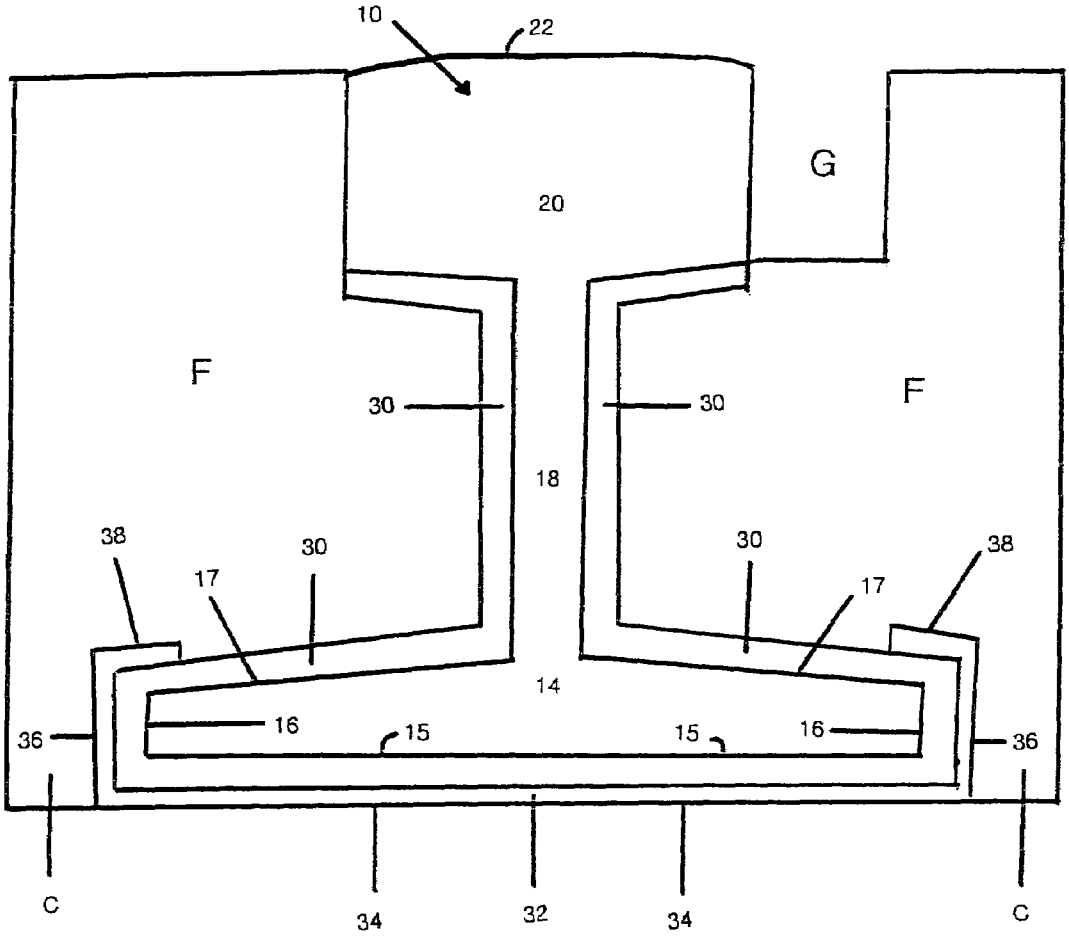
FIG. 2 is a cross-sectional view of another preferred form of rail in accordance with the present invention.

FIG. 2 illustrates another preferred embodiment in which a skid plate 32 of generally channel-shaped cross-sectional configuration is mounted on the rail directly to the rail cover 30 extending along the underside 15 and opposite sides 16 of the base flange 14. Thus, the skid plate 32 includes a substantially flat base 34 and opposite sides 36 which are bent into generally concavo-convex configuration in tightly surrounding relation to the opposite sides 16 and terminate in upper edges 38 which overlie outer ends of the sloped upper surfaces 17.

The rail cover 30 is vulcanized by subjecting to high pressure and super-heated steam so as to bond the cover both to the steel rail 10 and skid plate 32. This procedure creates an impermeable barrier which protects the surrounding environment from the costly and often hazardous ravages of electrolytic corrosion. In the form of FIG. 2, the sides of the rail cover are of uniform thickness and terminate along the undersides of the top flange.

Figure 3:
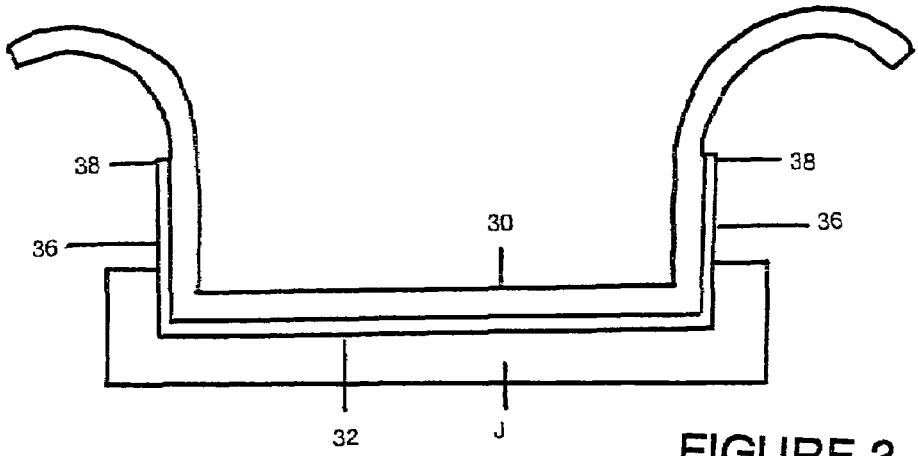
FIG. 3 is a cross-sectional view illustrating one step in the process of manufacturing the form of invention shown in FIG. 2.
Figure 4:
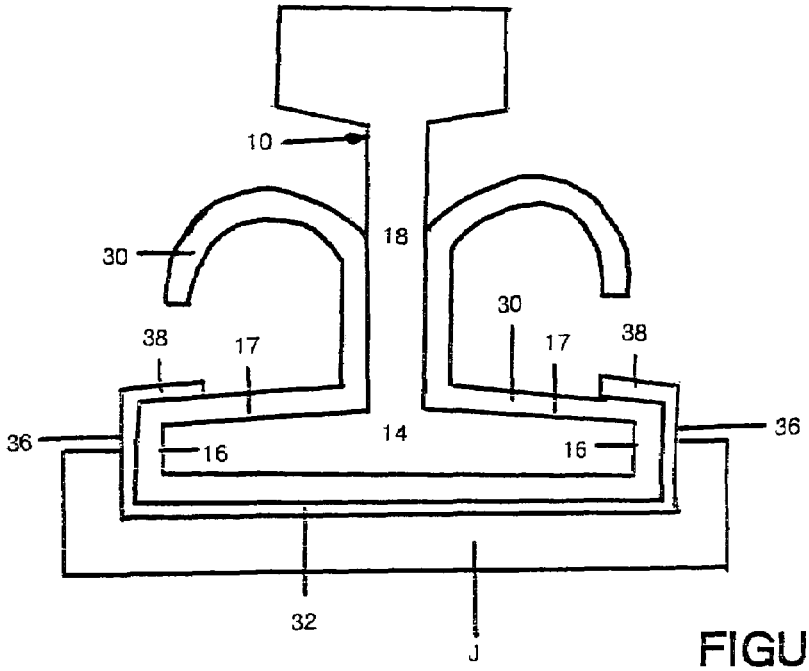
FIG. 4 is a cross-sectional view of another step involved in the process of manufacturing the form of invention shown in FIG. 2.

FIGS. 3 and 4 illustrate the steps followed in the fabrication of the preferred form of rail system as hereinbefore described. The rail 10 is customarily cut into 40' long sections, and a bonding agent is applied to the bottom flange 14 and web portion 18 as well as the undersides of the top flange 20 throughout the entire length of the section. The sheets of rubber making up the rail cover 30 are cut into shorter lengths than the rail section so as to leave several inches at each of the rail section exposed for welding the section ends as hereinafter described. Similarly, the skid plate 32 is formed into sections slightly shorter in length than the rail sections 10 so as not to interfere with the welding operation. At the manufacturing site, each skid plate section 32 is positioned in a steel channel jig J and, as illustrated in FIG. 3, each length of the rail cover 30 is placed in the skid plate 32 with opposite sides of the cover 30 extending upwardly beyond opposite sides 36 of the skid plate 32. The upper ends 38 of the opposite sides 36 are bent or crimped over the outer ends of the rail. Again, a suitable bonding agent is placed along the inner contacting surfaces of the rail 10 as a preliminary to applying the free sides of the cover 30 into contacting relation to the upper surfaces 17 and opposite sides of the web section 18 into the configuration illustrated in FIG. 4, although it will be appreciated that the bonding agent may be applied to the entire inner surface of the entire cover 30 rather than the rail 10 prior to placement beneath the rail. A suitable crimping tool is then employed to crimp the upper ends 38 of the skid plate 32 over the outer ends of the upper surfaces 17.

Each rail section is typically on the order of 40' in length and may be vulcanized in a suitable press to subject it to the desired temperature over a predetermined time interval depending to a great extent on the thickness of the cover 30. For the purpose of illustration but not limitation, the rail cover 30 may be on the order of ¼" thick for a rail which is on the order of 8" high. The composition of the rail cover 30 is totally impervious to moisture penetration and is highly resistant to harsh chemicals, such as, street de-icers, other acids or salts and automotive exhaust gases. It can withstand severe impact and abrasion and the usual rough handling and hauling from the plant to the rail site.

The skid plate 32 is useful as a means of protecting the rail cover when installed in the rail bed. For example, in an electric transit system, each rail of the railroad track is placed in a separate channel or shallow recess formed in the pavement of the roadway, as illustrated in FIGS. 1 and 2. As best seen from FIG. 5, typically the ends of the rail section are welded together as at 50 and the weld seams are insulated by on-site application of a sealant. If it should be necessary to leave a gap between the end of the cover 30 and the end of rail section 10, a heat-cured patch 52 is applied to the exposed ends of the rail sections 10 between the terminal edges of the rail covers 30 of adjoining rail sections. Preferably, the patch 52 is molded or extruded into the same cross-sectional configuration as the rail cover 30 and cured a t the factory site. Upon completion of the welding operation, the patch 52 is slipped over the rail and chemically cured or heated with the opposite edges of the patch butt-welded or cured together with the ends of the rail covers 30 as designated at 54.

Figure 5:
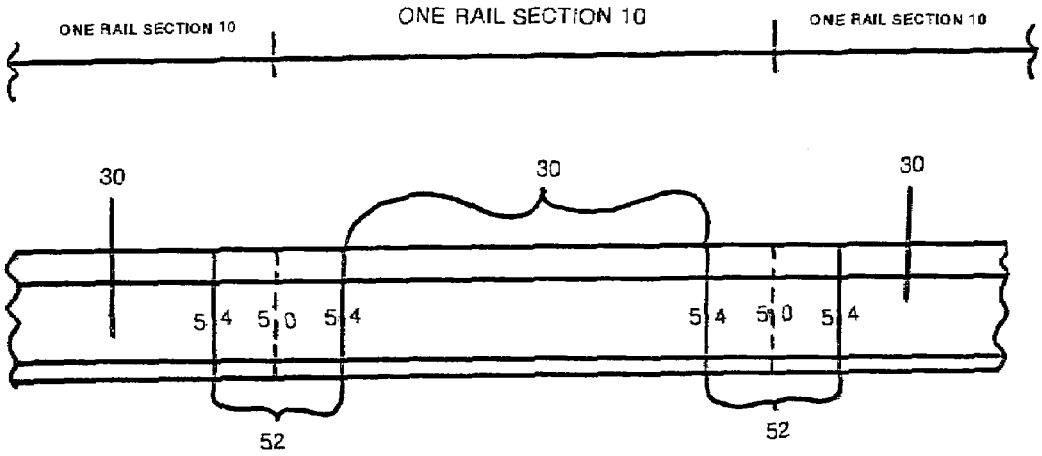
FIG. 5 is a side elevational view illustrating welded rail sections covered by a patch as a part of the insulated rail system.

FIG. 5 illustrates the rail sections welded together and patched as described without the use of skid plates 32. In other words, the rail 10 corresponds to that shown in FIG. 1 and may be installed in the rail channels C without adding the skid plates 32. Whether employed with or without the skid plates 32, a suitable filler as designated at F in FIGS. 1 and 2 is illustrated as being placed around the rails after they have been laid and welded in the channels. In either preferred form as shown in FIG. 1 or 2, the filler may be a concrete filler although it will be apparent that other types of commercial fillers may be employed, taking care to leave a gap G between the filler and one side 24 of the top flange 20 so as not to interfere with the train wheel.

It is therefore to be understood that while preferred forms of invention are herein set forth and described, the above and other modifications may be made therein without departing from the spirit and scope of the invention as defined by the appended claims and reasonable equivalents thereof.

What is claimed is:

1. A composite rail for trains or other vehicles, comprising:

a metal rail; and a laminate vulcanized to a portion of the metal rail utilizing a rubber to metal adhesive, wherein the laminate comprises two or more rubber-containing layers, wherein a first layer (i) is a closed cell foam rubber layer, and wherein a second layer (ii) of the laminate has less closed cell foam rubber than said first layer (i) or is free of closed cell foam rubber and is disposed on an outer surface of the laminate, wherein the laminate includes a third rubber layer (iii) having less closed cell foam rubber than said first layer (i) or is free of a closed cell foam rubber that is interposed between the rail and said first closed cell foam rubber layer (i), wherein the laminate is dielectric, and wherein the rail includes a bottom flange, a top flange adapted to support a train or other vehicle, and a web portion interconnecting the bottom flange and top flange.

2. The composite rail according to claim 1, wherein the first closed cell foam rubber layer (i) has a thickness of about 1 mm to about 30 mm, and wherein each of the second (ii) and the third (iii) rubber layers, independently, has a thickness of about 1 mm to about 20 mm.

3. The composite rail according to claim 2, wherein the first closed cell foam rubber layer (i) is derived from a composite comprising from about 1 to about 20 parts by weight of a blowing agent based on 100 total parts by weight of rubber in the first closed cell foam rubber layer (i).

4. The composite rail according to claim 3, wherein the blowing agent is sodium bicarbonate, p-toluene sulfonyl semicarbazide, p-p'-oxbis (benzenesulfonyl hydrazide), azodicarbonamide, or combinations therefore, and wherein the blowing agent is present in an amount from about 1 to about 10 parts by weight per 100 total parts by weight of rubber in the first closed cell foam rubber layer (i).

5. The composite rail according to claim 3, wherein the rubber utilized in each layer of the laminate independently is natural rubber, neoprene, or EPDM, or a combination thereof.

6. The composite rail according to claim 3, wherein the laminate is connected to at least the bottom flange and the web portion of the rail to an underside of the top flange of the rail on each side of the rail.

7. A street or rail bed having a composite rail according to claim 6 connected therein.

8. The composite rail according to claim 1, wherein the first closed cell foam rubber layer (i) has a thickness of about 3 mm to about 10 mm, and wherein each of the second (ii) and the third (iii) rubber layer, independently, has a thickness of about 2 mm to about 4 mm.

9. A street or rail bed having a composite rail according to claim 1 connected therein.

10. The composite according to claim 1, wherein a second vulcanized laminate comprising one or more rubber layers is connected to a portion of the vulcanized laminate.

11. A composite including a closed cell foam rubber layer, comprising:

a substrate having a dielectric laminate cured thereon, wherein the laminate includes a closed cell foam rubber layer interposed between a first rubber layer and a second rubber layer, said first and second rubber layers comprising less closed cell foam rubber than the closed cell foam rubber layer or free of closed cell foam rubber, said closed cell foam rubber layer derived from a composition including a blowing agent.

12. The composite according to claim 11, wherein the closed cell foam rubber layer has a thickness of from about 1 mm to about 30 mm, and wherein the first and second rubber layers independently have a thickness of about 1 mm to about 20 mm.

13. The composite according to claim 12, wherein the substrate is metal, ceramic, plastic, rubber, elastomer, cement, concrete, or a combination thereof.

14. The composite according to claim 13, wherein the closed cell foam rubber layer is derived from a composition comprising from about 1 to about 20 parts by weight of a blowing agent based on 100 total parts by weight of rubber in the closed cell foam rubber layer.

15. The composite according to claim 14, wherein the rubber utilized in each layer of the laminate independently includes natural rubber, neoprene, or EPDM, or a combination thereof.

16. The composite according to claim 14, wherein the substrate is a rail, wherein the rail includes a bottom flange, a top flange adapted to support a train or other vehicle, and a web portion interconnecting the bottom flange and top flange, wherein the laminate is connected to at least the bottom flange and the web portion of the rail to an underside of the top flange of the rail on each side of the rail, and wherein the laminate is cured on the rail in the presence of a rubber-to-metal adhesive interposed between the laminate and the rail.

17. The composite according to claim 16, wherein the closed cell foam rubber layer has a thickness of about 3 mm to about 10 mm, and wherein each rubber layer free of a closed cell foam, independently, has a thickness of about 2 mm to about 4 mm.

18. A street or rail bed having a composite rail according to claim 17 connected therein.

19. The composite according to claim 11, wherein a second cured laminate comprising one or more rubber layers is connected to a portion of the cured laminate.

20. A method for preparing a composite rail, comprising the steps of:

applying an uncured laminate to a portion of a rail; and curing the laminate to form a composite rail, wherein the laminate comprises two or more layers, wherein a first rubber layer is a closed cell foam rubber layer derived from a rubber composition comprising a blowing agent, and wherein a second rubber layer of the laminate is disposed on an outer surface of the laminate, wherein the second rubber layer comprises less closed cell foam rubber than the first rubber layer or is free of closed cell foam rubber.

21. The method according to claim 20, wherein the laminate is cured without the use of a mold.

22. The method according to claim 21, wherein the laminate includes a third rubber layer interposed between the rail and first layer, wherein the third rubber layer comprises less closed cell foam rubber than the first rubber layer or is free of closed cell foam rubber, and wherein the laminate is dielectric.

23. The method according to claim 22, wherein the rail includes a bottom flange, a top flange adapted to support a train or other vehicle, and a web portion interconnecting the bottom flange and top flange, wherein the first rubber layer has a thickness of about 1 mm to about 30 mm, and wherein the second and third rubber layers, independently, have a thickness of about 1 mm to about 20 mm.

24. The method according to claim 23, wherein the first rubber layer is derived from a composition comprising from about 1 to about 20 parts by weight of a blowing agent based on 100 total parts by weight of rubber in the first rubber layer.

25. The method according to claim 24, wherein the rubber utilized in each layer of the laminate independently is natural rubber, neoprene, or EPDM, or a combination thereof, and wherein the laminate is connected to at least the bottom flange and the web portion of the rail to an underside of the top flange of the rail on each side of the rail.

26. The method according to claim 20, further including the step of calendering or extruding individually each layer of the laminate followed by calendaring the layers together prior to curing to form the laminates, and wherein the calendering or extrusion, or a combination thereof, is conducted at a temperature below the activation temperature of a blowing agent utilized in the closed cell foam rubber layer.

27. The method according to claim 26, wherein the laminate is cured in an autoclave at a temperature of about 121° C. to about 177° C. and at a pressure of about 775 mm of mercury to about 6206 mm of mercury.

28. The method according to claim 27, when the curing temperature is from 137° C. to about 160° C., and wherein the pressure is about 1396 mm of mercury to about 4654 mm of mercury.

29. The method according to claim 20, further including the step of connecting the composite rail to a street or rail bed.

* * * * *